US011982148B2

(12) United States Patent
Ross et al.

(10) Patent No.: US 11,982,148 B2
(45) Date of Patent: May 14, 2024

(54) WELLHEAD APPARATUS, ASSEMBLY AND METHOD FOR SUPPORTING DOWNHOLE TUBING

(71) Applicant: Baker Hughes Energy Technology UK Limited, Bristol (GB)

(72) Inventors: Michael Ross, Aberdeen (GB); Stanley Hosie, Katy, TX (US)

(73) Assignee: Baker Hughes Energy Technology UK Limited, Bristol (GB)

( * ) Notice: Subject to any disclaimer, the term of this patent is extended or adjusted under 35 U.S.C. 154(b) by 0 days.

(21) Appl. No.: 17/753,226

(22) PCT Filed: Aug. 28, 2020

(86) PCT No.: PCT/EP2020/025388

§ 371 (c)(1),
(2) Date: Feb. 24, 2022

(87) PCT Pub. No.: WO2021/037397

PCT Pub. Date: Mar. 4, 2021

(65) Prior Publication Data

US 2022/0290522 A1 Sep. 15, 2022

(30) Foreign Application Priority Data

Aug. 29, 2019 (GB) ..... 1912403
Aug. 26, 2020 (GB) ..... 2013396

(51) Int. Cl.
*E21B 33/04* (2006.01)
*E21B 33/035* (2006.01)

(52) U.S. Cl.
CPC ..... *E21B 33/04* (2013.01); *E21B 33/035* (2013.01)

(58) Field of Classification Search
CPC ..... E21B 33/04; E21B 33/035
See application file for complete search history.

(56) References Cited

U.S. PATENT DOCUMENTS 5,145,006 A 9/1992 June
5,465,794 A 11/1995 McConaughy
(Continued)

FOREIGN PATENT DOCUMENTS

EP 0572732 A1 12/1993
GB 2150245 A 6/1985
(Continued)

OTHER PUBLICATIONS

Examination Report dated Mar. 2, 2022 in corresponding GB Application No. GB2013396.3.

*Primary Examiner* — Aaron L Lembo
(74) *Attorney, Agent, or Firm* — Hogan Lovells US LLP

(57) ABSTRACT

A wellhead assembly (100) comprises a wellhead apparatus (10) having a tubular body (16) defining an axial throughbore (18), a tubing hanger (12) for supporting downhole tubing (14) and associated downhole tools and equipment within the wellhead assembly (10), and more particularly orientating the tubing hanger (12) relative to a conductor (36). The wellhead apparatus (10) comprises a tubing hanger alignment arrangement (32) which in the illustrated apparatus (10) takes the form of a helical profile provided in an axial throughbore (18) of the tubular body (16). The tubing hanger alignment arrangement (32) is configured to engage an alignment arrangement (34) of the tubing hanger (12) so as to orient the tubing hanger (12) relative to the wellhead apparatus (10) as the tubing hanger (12) is run into the tubular body (16).

25 Claims, 10 Drawing Sheets

(56) References Cited

U.S. PATENT DOCUMENTS

| | | | | |
|---|---|---|---|---|
| 5,503,230 | A | 4/1996 | Osborne | |
| 6,394,192 | B1 * | 5/2002 | Frazer | E21B 7/124 175/58 |
| 7,770,650 | B2 * | 8/2010 | Young | E21B 23/004 166/344 |
| 8,950,500 | B2 * | 2/2015 | Lieske, II | E21B 43/0122 166/71 |
| 8,955,594 | B2 * | 2/2015 | Bell | E21B 33/035 166/341 |
| 11,421,501 | B2 | 8/2022 | Murphy | |
| 11,746,631 | B2 * | 9/2023 | Laing | F04F 5/12 166/244.1 |
| 2004/0231835 | A1 | 11/2004 | Thai et al. | |
| 2010/0224373 | A1 | 9/2010 | Williams et al. | |
| 2011/0155383 | A1 * | 6/2011 | Christiansen | E21B 17/015 166/345 |
| 2011/0168402 | A1 * | 7/2011 | C. Nadarajah | E02B 17/08 166/365 |
| 2013/0239866 | A1 * | 9/2013 | Maher, IV | E21B 17/017 114/264 |
| 2014/0064855 | A1 * | 3/2014 | Hammer | E21B 43/013 405/169 |
| 2014/0166298 | A1 * | 6/2014 | Fenwick | E21B 23/00 166/360 |
| 2015/0159458 | A1 | 6/2015 | Tan et al. | |
| 2015/0259990 | A1 | 9/2015 | June | |
| 2019/0137005 | A1 * | 5/2019 | Endal | F16L 1/16 |
| 2019/0162038 | A1 * | 5/2019 | Reinås | E21B 33/038 |
| 2019/0376250 | A1 * | 12/2019 | Grytdal | B63B 21/502 |
| 2020/0149373 | A1 * | 5/2020 | Souza | H01B 7/046 |
| 2020/0298944 | A1 * | 9/2020 | Bowie | B65D 90/20 |
| 2020/0392813 | A1 * | 12/2020 | Castello | E21B 36/001 |
| 2021/0054723 | A1 * | 2/2021 | Jacobsen | E21B 43/36 |
| 2021/0172139 | A1 * | 6/2021 | Duncan | E02D 27/52 |
| 2021/0270104 | A1 * | 9/2021 | Løvoll | E21B 33/043 |
| 2021/0372221 | A1 * | 12/2021 | Osen | E21B 41/08 |

FOREIGN PATENT DOCUMENTS

| | | | | |
|---|---|---|---|---|
| GB | 2429990 A | * | 3/2007 | E21B 33/038 |
| GB | 2442567 | | 4/2008 | |
| WO | 01/65050 | | 9/2001 | |
| WO | 2015/054766 | | 4/2015 | |
| WO | 2017/091084 | | 6/2017 | |
| WO | 2019/209698 | | 10/2019 | |

* cited by examiner

WELLHEAD APPARATUS, ASSEMBLY AND METHOD FOR SUPPORTING DOWNHOLE TUBING

FIELD

This relates to a wellhead apparatus, assembly and method for supporting downhole tubing and associated downhole tools and equipment. More particularly, this relates to a wellhead apparatus, assembly and method for orienting a tubing hanger for supporting downhole tubing and associated downhole tools and equipment.

BACKGROUND

In the oil and gas exploration and production industry, wells are drilled to access subsurface hydrocarbon-bearing rock formations, the well boreholes typically then being lined ("cased") with sections of bore-lining tubing known as casing which is then cemented in place.

In the case of subsea well installations, the well borehole is typically drilled from an offshore platform or vessel which communicates with the wellhead located on the seabed via a riser. A valve assembly, known as a tree, is deployed and connected to the wellhead, the tree controlling access to/from the well via a system of valves and other components.

The wellhead acts to support and seal the casing string, typically via a casing hanger arrangement mounted within the wellhead. Conventionally, smaller diameter downhole tubing is then supported within the wellhead by a tubing hanger which is landed on the casing hanger.

Wellbore infrastructure is becoming ever more complex, such that in addition to the downhole tubing itself, the tubing hanger may support a variety of downhole tools and equipment, such as valves, sleeves, inflow control devices or the like as well as downhole communication cables and control lines, many of which require accurate placement and knowledge of their depth and/or orientation in order to function effectively.

In conventional systems, installation of the tubular hanger in the wellhead is achieved using an Orientation Spool, Blow Out Preventer (BOP) Pin (typically used in shallow water applications) or Tubing Head Spool (typically used in deep water applications).

However, there are a number of challenges with conventional equipment.

Wellbore construction is a time consuming exercise and involves significant cost which must be recovered over the life of the well. The use of Orientation Spools, Blow Out Preventer (BOP) Pins or Tubing Head Spools, for example, may involve costs in the region US$1 million to US$2 million, per well.

Moreover, Orientation Spool and Tubing Head Spool equipment increases the fatigue loading on the wellhead, which may result in reduced mean time before failure (MTBF) requiring intervention operations to be carried at significant cost to an operator.

SUMMARY

According to a first aspect, there is provided a wellhead apparatus for supporting downhole tubing, comprising:

a tubular body defining an axial throughbore therethrough, wherein the wellhead apparatus is configured to receive a tubing hanger for supporting downhole tubing from the wellhead; and a tubing hanger alignment arrangement provided in the axial throughbore of the wellhead apparatus, wherein the tubing hanger alignment arrangement is configured to engage a wellhead alignment arrangement of the tubing hanger so as to orient the tubing hanger relative to the wellhead on location of the tubing hanger in the wellhead apparatus.

The wellhead apparatus provides a number of benefits over conventional tools and equipment. For example, the wellhead apparatus incorporates the orientation of the tubing hanger and thus the associated downhole tubing, tools and equipment into the wellhead, facilitating the correct orientation of the tubing hanger in the wellhead without the requirement for an Orientation Spool, BOP pin or Tubing Head Spool as is required with conventional wellbore construction equipment, reducing costs and installation duration. Moreover, by eliminating the need for the Orientation Spool or Tubing Head Spool, the wellhead apparatus reduces installation time and thus involves lower fatigue loading on the wellhead system. Incorporating the orientation of the tubing hanger into the wellhead also permits the system to be fully verified prior to deployment, e.g. at an onshore location, thereby providing greater confidence of successful installation offshore and reducing the likelihood of a failure which would otherwise require a remedial or intervention operation to be carried out at significant cost and time.

In particular embodiments, the wellhead apparatus takes the form of a subsea wellhead. The wellhead apparatus is particularly beneficial in subsea applications due to the complexities in performing operations in the subsea environment and the need to provide accurate orientation of the tubing hanger and associated downhole tubing and equipment. However, it will be recognized that the wellhead apparatus may alternatively take the form of an onshore wellhead apparatus.

In use, the wellhead apparatus is configured for location on a conductor casing (known in the art and referred hereinbelow as "the conductor") extending upwards from the seabed. In particular embodiments, and as will be described further below, the conductor may take the form of a suction can. Beneficially, the use of a suction can as the initial conductor provides accurate control over the orientation of the conductor, and thus accurate control over the orientation of the wellhead apparatus and/or production guide base located on the conductor. In turn, the tubing hanger alignment arrangement facilitates accurate alignment between the tubing hanger and the wellhead apparatus, and thus between the tubing hanger and associated downhole tubing and equipment with the conductor.

The tubing hanger alignment arrangement may be integrally formed with the wellhead apparatus. For example, the tubing hanger alignment arrangement may be integrally formed with the tubular body of the wellhead apparatus.

Alternatively, the tubing hanger alignment arrangement may be disposed on a separate component, e.g. a sleeve, configured for location in the axial throughbore of the tubular body. In such cases, the separate component may be configured for coupling to the wellhead apparatus.

The tubing hanger alignment arrangement may comprise or take the form of a profile. The profile may be provided in the axial throughbore of the tubular body. The profile may comprise or take the form of a helical profile ("orientation helix"). The profile may form a keyway for receiving and guiding the wellhead alignment arrangement of the tubing hanger.

The wellhead apparatus may comprise a first housing portion. The first housing portion may comprise or take the form of a high pressure housing unit ("HP housing unit"). It will be recognized that the term high pressure is used with respect to the HP housing unit, this has a well-recognized meaning in the art. The first housing portion may be tubular or generally tubular in construction having an axial throughbore therethrough.

The tubing hanger alignment arrangement may be provided in the first housing portion. In embodiments where the tubing hanger alignment arrangement is integrally formed in the wellhead apparatus, the tubing hanger alignment arrangement may be integrally formed in the first housing portion. In embodiments where the tubing hanger alignment arrangement is provided on a separate component, the separate component may be disposed within the first housing portion.

The wellhead apparatus may comprise a second housing portion. The second housing portion may comprise or take the form of a low pressure housing unit ("LP housing unit"). It will be recognized that while the term low pressure is used with respect to the LP housing unit, this has a well-recognized meaning in the art. The second housing portion may be tubular or generally tubular in construction having an axial throughbore therethrough.

The second housing portion may be configured for coupling to the conductor. In particular embodiments, the second housing portion may be coupled to the conductor via a weld connection. However, it will be understood that the second housing portion may be coupled to the conductor by any suitable coupling arrangement.

The second housing portion may be configured to receive the first housing portion. An uphole end portion of the second housing portion may be configured to receive a downhole end portion of the first housing portion. Alternatively or additionally, the first housing portion may be configured for location within the second housing portion.

The wellhead apparatus may be configured to receive a casing hanger arrangement. The wellhead apparatus may be configured to receive one or more casing hanger. The wellhead apparatus may be configured, e.g. shaped and/or dimensioned, to receive the casing hanger within the axial throughbore.

The wellhead apparatus may comprise a casing hanger support arrangement configured to support the casing hanger and associated downhole tubing, tools and/or equipment. The casing hanger support arrangement of the wellhead apparatus may comprise or take the form of a landing shoulder for receiving the casing hanger.

Alternatively, the casing hanger support arrangement may comprise a landing nipple, no-go or the like. The casing hanger support arrangement may be provided in, or coupled to, the axial throughbore of the wellhead apparatus. The casing hanger support arrangement may be provided in the first housing portion of the wellhead apparatus.

In use, a casing hanger may be run into the axial throughbore of the wellhead apparatus and landed on casing hanger support arrangement. The tubing hanger may then be run into the axial throughbore of the wellhead apparatus and landed on the casing hanger.

The wellhead apparatus may comprise a lock arrangement for locking the tubing hanger in place on location of the tubing hanger in the wellhead apparatus. The lock arrangement of the wellhead apparatus may be configured to engage a locking arrangement of the tubing hanger. The lock arrangement of the wellhead apparatus may comprise or take the form of a lock recess or profile provided in the wellhead apparatus. The lock arrangement of the wellhead apparatus may comprise or take the form of a lock recess or profile provided in the axial throughbore of the tubular body of the wellhead apparatus. The lock arrangement of the wellhead apparatus may be disposed at an uphole location relative to the landing shoulder. The tubing hanger alignment arrangement may be interposed between the lock arrangement of the wellhead apparatus and the casing hanger landing arrangement of the wellhead apparatus.

The wellhead apparatus may comprise a tubing hanger support arrangement. The tubing hanger support arrangement of the wellhead apparatus may comprise or take the form of a landing shoulder for receiving the tubing hanger.

The wellhead apparatus may comprise a first end and a second end. In use, the first end may define an uphole end (i.e. closer to surface) and the second end may define a downhole end.

The first end of the wellhead apparatus may define a connector for coupling the wellhead apparatus to a production guide base, and tree. In particular, but not exclusively, the connector may take the form of a threaded pin connector or the like.

The first end may be defined by the first housing portion of the wellhead apparatus.

The second end may be defined by the second housing portion of the wellhead apparatus.

The tubing hanger alignment arrangement may be interposed between the tubing hanger lock arrangement and the casing hanger landing arrangement.

The apparatus may comprise an alignment arrangement for orienting the first housing portion relative to the conductor housing.

The alignment arrangement may comprise a castellated profile. The castellated profile may be formed or provided on the conductor housing. The castellated profile may comprise one or more castellation. In particular, the castellated profile may comprise a plurality of castellations. The castellations may be circumferentially arranged and/or spaced.

The castellated profile may, for example, comprise twelve castellations. The castellations may be disposed at 30 degree circumferential spacing. Beneficially, this reduces the rotation required in order to engage the orientation arrangement and thus align and lock the orientation of the first housing portion and the conductor housing. However, it will be understood that the castellated profile may comprise any suitable number of castellations.

The castellated profile may be formed on the conductor housing. Alternatively, the castellated profile may be provided on a separate member, for example a ring member. The member may be configured for coupling to the conductor housing.

The member may comprise a unitary construction. Alternatively, the member may comprise a plurality of components, for example segments. A coupling arrangement may be provided for coupling the components together. The coupling arrangement may comprise one or more fasteners, such as screws, bolts or the like.

The castellated profile may comprise peaks and troughs. The peaks may be defined by the top of the one or more castellations. The troughs may be defined between the castellations. Each castellation may generally take the form of a tooth having tapered surfaces.

The alignment arrangement may comprise a pin arrangement. The pin arrangement may be configured to engage the castellated profile.

The pin arrangement may comprise one or more pin. In particular, the pin arrangement may comprise a plurality of pins. The pins may be circumferentially arranged and/or spaced.

In use, the one or more pin may interface with the one or more castellation on to lock the orientation of the first housing portion relative to the conductor housing.

The apparatus may comprise an orientation profile and/or latching profile for alignment with and/or attaching a production flow base and/or for tree alignment. The orientation profile and/or latching profile may be formed or otherwise provided on the conductor housing. The orientation profile and/or latching profile may extend radially.

The apparatus may further comprise one or more orientation slot configured to receive the tubing hanger orientation sleeve. The one or more orientation slot may be formed in or coupled to the orientation sleeve. The one or more orientation slot may be formed in or coupled to an inner surface of the orientation sleeve.

The position of the one or more orientation slot may be predetermined or preselected so as to provide a known position relative to the pin arrangement. For example, the position of the one or more orientation slot may be predetermined or preselected so as to provide a known position relative to a given pin ("king pin") of the pin arrangement.

Beneficially, engagement of the orientation sleeve with the one or more orientation slot may align the sleeve with the first housing portion, which in turn is aligned relative to the conductor housing via the orientation arrangement.

The sleeve may comprise an orientation key spring loaded orientation key.

The sleeve may comprise one or more orientation key position slots.

It will be recognized that correction of the tubing hanger orientation can be achieved either by way of a moveable key on the orientation sleeve and a fixed key on the tubing hanger or by a moveable key on the tubing hanger and a fixed key on the body of the tubing hanger.

According to a second aspect, there is provided a wellhead assembly comprising:

the wellhead apparatus of the first aspect; and a tubing hanger.

The wellhead assembly provides a number of benefits over conventional tools and equipment. For example, the wellhead assembly incorporates the orientation of the tubing hanger and thus the associated downhole tubing, tools and equipment into the wellhead apparatus, facilitating the correct orientation of the tubing hanger in the wellhead assembly without the requirement for an Orientation Spool, BOP pin or Tubing Head Spool as is required with conventional wellbore construction equipment, reducing costs and installation duration. Moreover, by eliminating the need for the Orientation Spool or Tubing Head Spool, the wellhead assembly reduces installation time and thus involves lower fatigue loading on the wellhead system. Incorporating the orientation of the tubing hanger into the wellhead assembly also permits the system to be fully verified prior to deployment, e.g. at an onshore location, thereby providing greater confidence of successful installation offshore and reducing the likelihood of a failure which would otherwise require a remedial or intervention operation to be carried out at significant cost and time.

The tubing hanger may comprise a tubular or generally tubular body comprising an axial throughbore therethrough. The tubing hanger may be configured to receive downhole tubing, such as a downhole tubing string. In use, the tubing hanger may receive and support the downhole tubing.

The tubing hanger may comprise a wellhead alignment arrangement. The wellhead alignment arrangement may be configured to engage the tubing hanger alignment arrangement of the wellhead apparatus, as described above.

The wellhead alignment arrangement of the tubing hanger may comprise or take the form of a key.

In use, the wellhead alignment arrangement of the tubing hanger may engage the tubing hanger alignment arrangement of the wellhead apparatus as the tubing hanger is run into the wellhead apparatus, the wellhead alignment arrangement guiding the tubing hanger to the required orientation as the tubing hanger progresses through the wellhead apparatus.

As described above, the wellhead apparatus may comprise a lock arrangement, e.g. a lock recess or profile provided in the axial throughbore of the tubular body of the wellhead apparatus, for locking the tubing hanger in place on location of the tubing hanger in the wellhead apparatus. The tubing hanger may comprise a lock arrangement for engaging the lock arrangement of the wellhead apparatus. The lock arrangement of the tubing hanger may be carried by the tubing hanger. The lock arrangement of the tubing hanger may comprise one or more lock dogs or the like. In use, the lock arrangement of the tubing hanger, e.g. one or more lock dogs, engages the lock arrangement of the wellhead apparatus, e.g. lock recess or profile, when the tubing hanger lands in the wellhead assembly, more particularly in the casing hanger.

The lock arrangement may be biased to a radially outwards position such that the lock arrangement of the tubing hanger automatically engages the lock arrangement of the wellhead apparatus when the tubing hanger lands in the wellhead assembly.

Alternatively or additionally, the lock arrangement may be actuated to a radially outwards position by an actuation mechanism such that the lock arrangement of the tubing hanger engages the lock arrangement of the wellhead apparatus when the tubing hanger lands in the wellhead assembly.

The wellhead apparatus may be configured so that the lock arrangement of the wellhead apparatus is aligned with the lock arrangement of the tubing hanger when the tubing hanger seats on the casing hanger.

The tubing hanger may comprise one or more orientation key position slots. The tubing hanger may comprise a plurality of orientation key position slots.

The wellhead assembly may comprise a casing hanger arrangement. The casing hanger arrangement may comprise one or more casing hanger. The casing hanger arrangement may comprise a dummy hanger. The dummy hanger may be configured to land on the support arrangement of the wellhead apparatus. The dummy hanger may define a profile configured to land on the support arrangement of the wellhead apparatus.

The casing hanger arrangement, in particular the casing hanger, may be configured to receive the tubing hanger. The tubing hanger may comprise a seal arrangement. In particular embodiments, the seal arrangement of the tubing hanger may interface with and seal within the casing hanger arrangement. However, it will be understood that the seal arrangement of the tubing hanger may alternatively interface with and seal within the wellhead apparatus, in particular the first housing portion.

The wellhead assembly may comprise a seal arrangement.

The seal arrangement may be disposed between and/or formed by the casing hanger arrangement, in particular the casing hanger, and the wellhead apparatus, in particular the first housing portion of the wellhead apparatus.

The seal arrangement may comprise or take the form of a metal-to-metal seal arrangement.

The wellhead apparatus may be provided in a number of different configurations.

In one configuration, the first housing portion may be a 18¾" (476.25 mm) housing unit and the casing hanger may be a 18.12" (460.25 mm) casing hanger.

In a dual internal casing string configuration, the axial throughbore of the tubular body may be reduced, for example to 17¹⁄₁₆" (433.39 mm) and sealing bore may be reduced, for example to 18.12" (460.25 mm). In such embodiments, the seal arrangement, tubing hanger are adapted. Beneficially, this provides space for the tubing hanger alignment arrangement.

In another configuration, for example but not exclusively a slim well configuration comprising one casing string set within the wellhead apparatus, the first housing portion may have a nominal inner diameter of 18¾" (476.25 mm) and have a portion having an inner diameter of 16¾" (425.45 mm) configured to receive the casing hanger. The casing hanger may have an outer diameter of 16¾" (425.45 mm) for supporting 9⅝" (244.48 mm) casing. Beneficially, this permits the tubing hanger alignment arrangement of the wellhead apparatus to be located within the wellhead apparatus, more particularly within the first housing portion, between the casing hanger and the tubing hanger support arrangement, seal arrangement and/or lock arrangement.

In each of the above configurations, the installation of the tubing hanger is simplified, resulting in lower costs and lower fatigue loading on the wellhead system, and can be fully verified onshore prior to deployment and so provide a greater degree of confidence of successful installation in the offshore environment, and reducing the likelihood of a failure which would otherwise require a remedial or intervention operation to be carried out at significant cost and time.

A third aspect relates to a method, the method comprising use of the wellhead apparatus of the first aspect or the wellhead assembly of the second aspect to support downhole tubing.

The method provides a number of benefits over conventional tools and equipment. For example, the wellhead apparatus incorporates the orientation of the tubing hanger and thus the associated downhole tubing, tools and equipment into the wellhead, facilitating the correct orientation of the tubing hanger in the wellhead without the requirement for an Orientation Spool, BOP pin or Tubing Head Spool as is required with conventional wellbore construction equipment, reducing costs and installation duration. Moreover, by eliminating the need for the Orientation Spool or Tubing Head Spool, the wellhead apparatus reduces installation time and thus involves lower fatigue loading on the wellhead system. Incorporating the orientation of the tubing hanger into the wellhead also permits the system to be fully verified prior to deployment, e.g. at an onshore location, thereby providing greater confidence of successful installation offshore and reducing the likelihood of a failure which would otherwise require a remedial or intervention operation to be carried out at significant cost and time.

More specifically, the method comprises use of the wellhead apparatus or assembly to support a tubing hanger for supporting downhole tubing and associated downhole tools and equipment in a wellhead.

More specifically, the method comprises use of the wellhead apparatus or assembly to orientate a tubing hanger for supporting downhole tubing and associated downhole tools and equipment in a wellhead.

In particular embodiments, the method may use of a suction can as the initial conductor. Beneficially, use of a suction can as the initial conductor provides accurate control over the orientation of the conductor, and thus accurate control over the orientation of the wellhead apparatus and/or production guide base located on the conductor. In turn, the tubing hanger alignment arrangement facilitates accurate alignment between the tubing hanger and the wellhead apparatus, and thus between the tubing hanger and associated downhole tubing and equipment with the conductor.

According to a fourth aspect, there is provided a wellhead apparatus for supporting downhole tubing, comprising:

a first housing portion;

a conductor housing;

an alignment arrangement for orienting the first housing portion relative to the conductor housing.

As in the previous aspects, the wellhead apparatus according to the fourth aspect provides a number of benefits over conventional tools and equipment. For example, the wellhead apparatus incorporates the orientation of the tubing hanger and thus the associated downhole tubing, tools and equipment into the wellhead, facilitating the correct orientation of the tubing hanger in the wellhead without the requirement for an Orientation Spool, BOP pin or Tubing Head Spool as is required with conventional wellbore construction equipment, reducing costs and installation duration. Moreover, by eliminating the need for the Orientation Spool or Tubing Head Spool, the wellhead apparatus reduces installation time and thus involves lower fatigue loading on the wellhead system. Incorporating the orientation of the tubing hanger into the wellhead also permits the system to be fully verified prior to deployment, e.g. at an onshore location, thereby providing greater confidence of successful installation offshore and reducing the likelihood of a failure which would otherwise require a remedial or intervention operation to be carried out at significant cost and time.

Moreover, embodiments of the fourth aspect provide the further benefit that they do not require initial orientation of the low pressure conductor housing to be carried out. Amongst other things, this eliminates the costs and time associated with the build and supply of the tubing head spool, and/or results in significant reductions in rig time and associated operational and transportation costs.

The alignment arrangement may comprise a castellated profile. The castellated profile may be formed or provided on the conductor housing. The castellated profile may comprise one or more castellation. In particular, the castellated profile may comprise a plurality of castellations. The castellations may be circumferentially arranged and/or spaced.

The castellated profile may, for example, comprise twelve castellations. The castellations may be disposed at 30 degree circumferential spacing. Beneficially, this reduces the rotation required in order to engage the orientation arrangement and thus align and lock the orientation of the first housing portion and the conductor housing. However, it will be understood that the castellated profile may comprise any suitable number of castellations.

The castellated profile may be formed on the conductor housing. Alternatively, the castellated profile may be provided on a separate member, for example a ring member. The member may be configured for coupling to the conductor housing.

The member may comprise a unitary construction. Alternatively, the member may comprise a plurality of components, for example segments. A coupling arrangement may be provided for coupling the components together. The coupling arrangement may comprise one or more fasteners, such as screws, bolts or the like.

The castellated profile may comprise peaks and troughs. The peaks may be defined by the top of the one or more castellations. The troughs may be defined between the castellations. Each castellation may generally take the form of a tooth having tapered surfaces.

The alignment arrangement may comprise a pin arrangement. The pin arrangement may be configured to engage the castellated profile.

The pin arrangement may comprise one or more pin. In particular, the pin arrangement may comprise a plurality of pins. The pins may be circumferentially arranged and/or spaced.

In use, the one or more pin may interface with the one or more castellation on to lock the orientation of the first housing portion relative to the conductor housing.

The first housing portion may comprise or take the form of a high pressure housing unit ("HP housing unit"). It will be recognized that the term high pressure is used with respect to the HP housing unit, this has a well-recognized meaning in the art. The first housing portion may be tubular or generally tubular in construction having an axial throughbore therethrough.

The conductor housing may form part of, or may be configured for coupling to, a conductor casing ("conductor"). The conductor housing may comprise or take the form of the second housing portion of the first aspect.

The conductor housing may be configured to receive the first housing portion. An uphole end portion of the conductor housing may be configured to receive a downhole end portion of the first housing portion. Alternatively or additionally, the first housing portion may be configured for location within the conductor housing.

According to a fifth aspect, there is provided a wellhead assembly comprising:

the wellhead apparatus of the fourth aspect; and a tubing hanger.

A sixth aspect relates to a method, the method comprising use of the wellhead apparatus of the fourth aspect or the wellhead assembly of the fifth aspect to support downhole tubing.

The invention is defined by the appended claims. However, for the purposes of the present disclosure it will be understood that any of the features defined above or described below may be utilized in isolation or in combination. For example, features described above in relation to one of the above aspects or below in relation to the detailed description below may be utilized in any other aspect, or together form a new aspect.

BRIEF DESCRIPTION OF THE DRAWINGS

These and other aspects will now be described, by way of example only, with reference to the accompanying drawings, in which.

DETAILED DESCRIPTION OF THE DRAWINGS

Figure 1:
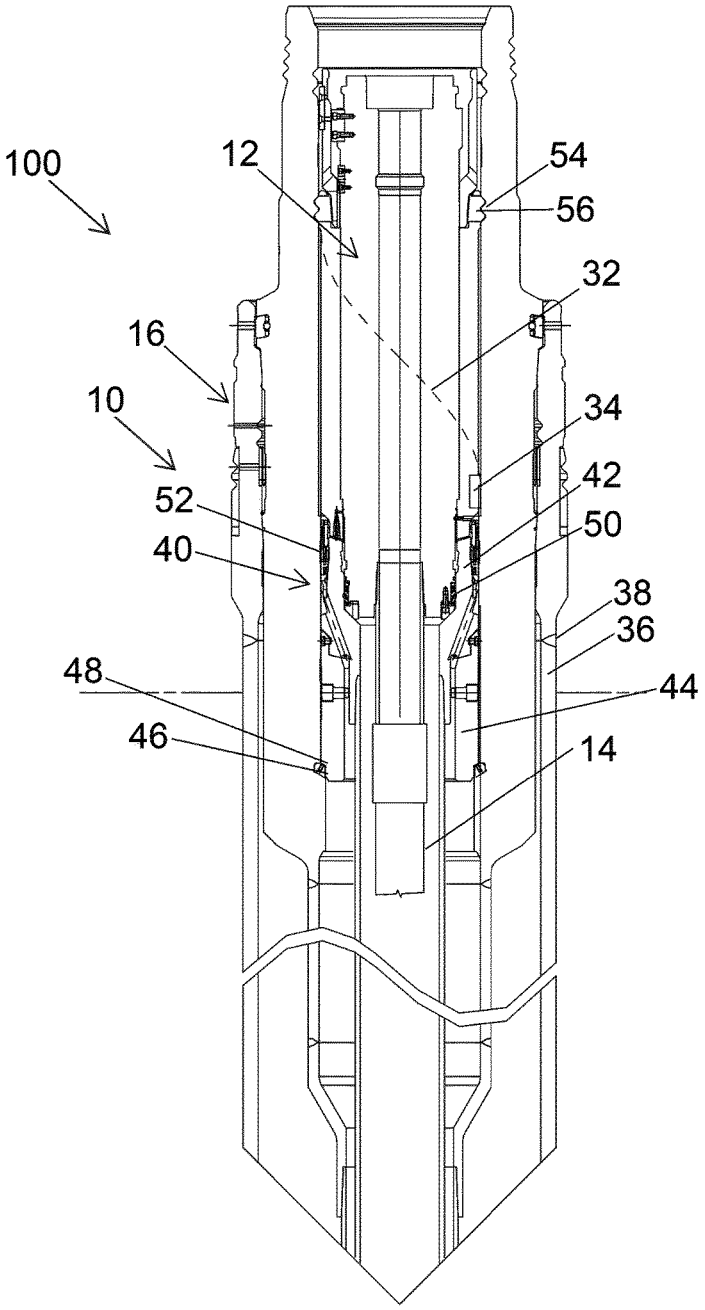
FIG. 1 shows a longitudinal sectional view of a wellhead assembly for supporting downhole tubing and associated downhole tools and equipment.

Referring first to FIG. 1 of the accompanying drawings, there is shown a wellhead assembly 100 comprising a wellhead apparatus 10 and a tubing hanger 12 for supporting downhole tubing 14 and associated downhole tools and equipment within the wellhead apparatus 10, and more particularly orientating the tubing hanger 12.

The illustrated wellhead assembly 100 shown in FIG. 1 takes the form of a subsea wellhead assembly. However, it will be recognized that the wellhead assembly may alternatively take the form of an onshore wellhead apparatus.

Figure 2:
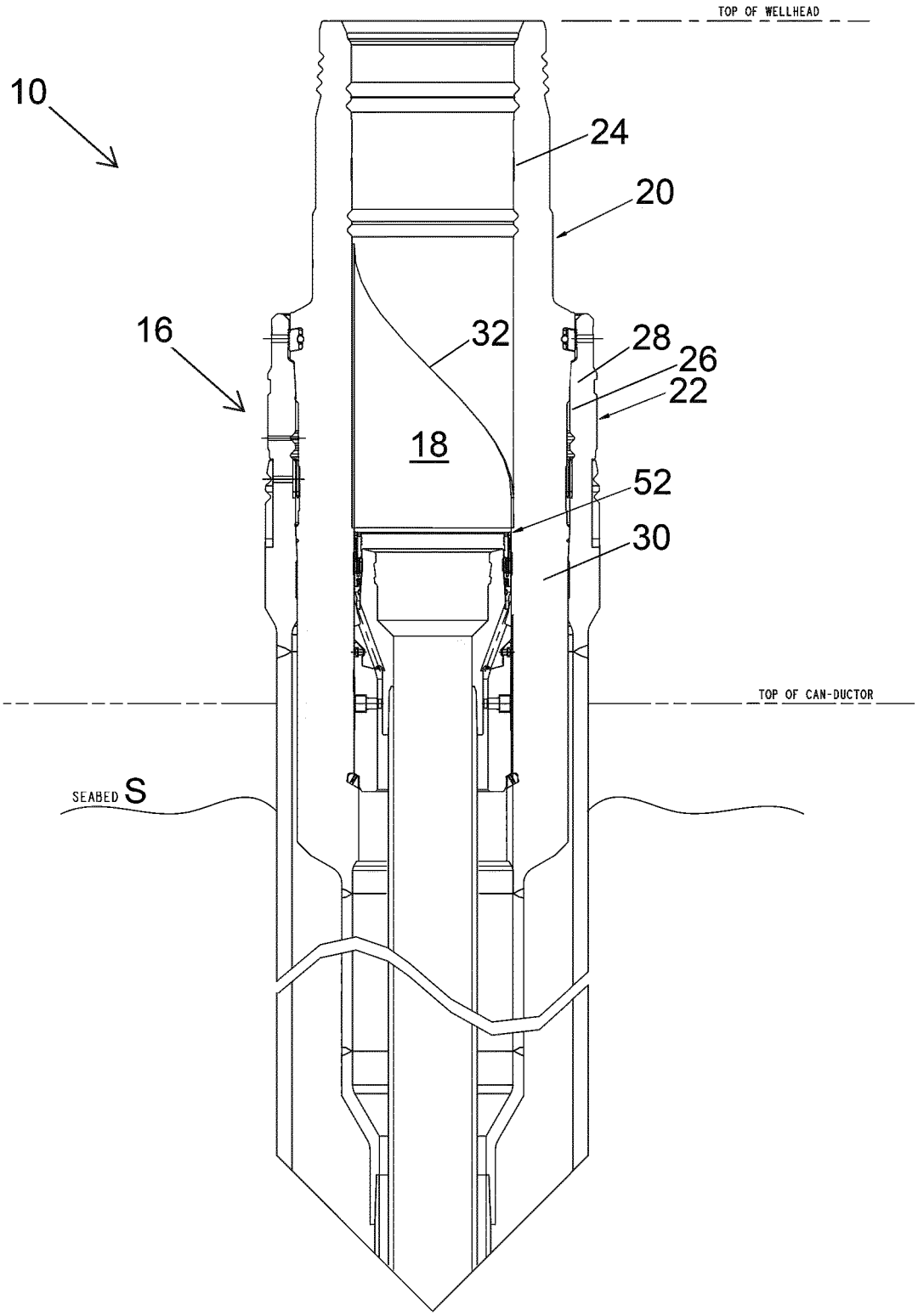
FIG. 2 shows the wellhead apparatus of the wellhead assembly shown in FIG. 1.
Figure 3:
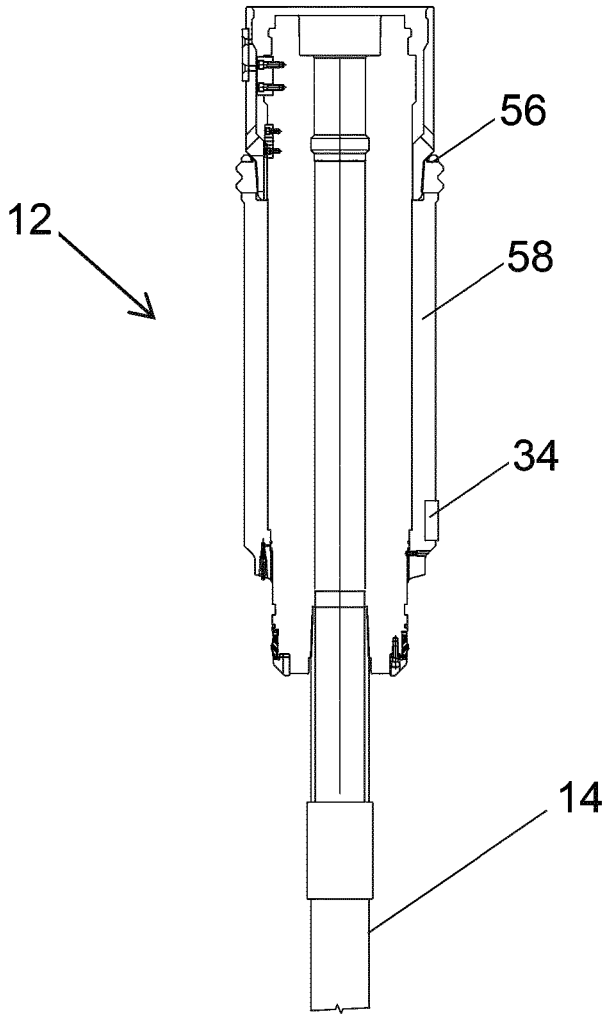
FIG. 3 shows the tubing hanger of the wellhead assembly shown in FIG. 1.

As shown in FIG. 1, and referring now also to FIG. 2 of the accompanying drawings, the wellhead apparatus 10 comprises a tubular body, generally denoted 16, defining an axial throughbore 18 therethrough. The body 16 comprises a first housing portion 20 in the form of high pressure (HP) housing unit and a second housing portion 22 in the form of low pressure (LP) housing unit. The first housing portion 20 and the second housing portion 22 together form the tubular body 16. The first housing portion 20 is tubular or generally tubular in construction having an axial throughbore 24 therethrough. The second housing portion 22 is also tubular or generally tubular in construction having an axial throughbore 26. As shown in FIG. 1, the second housing portion 22 is configured to receive the first housing portion 20, an uphole end portion 28 of the second housing portion 22 configured to receive a downhole end portion 30 of the first housing portion 20.

As will be described further below, the wellhead apparatus 10 comprises a tubing hanger alignment arrangement 32 which in the illustrated apparatus 10 takes the form of a helical profile provided in the axial throughbore 18 of the tubular body 16, more particularly in the axial throughbore 24 of the first housing portion 20. The tubing hanger alignment arrangement 32 is configured to engage a wellhead alignment arrangement 34 of the tubing hanger 12 so as to orient the tubing hanger 12 relative to the wellhead apparatus 10 as the tubing hanger 12 is run into the tubular body 16, the alignment arrangement 34 in the illustrated assembly 100 taking the form of a key. The tubing hanger alignment arrangement 32 forms a keyway for receiving and guiding the wellhead alignment arrangement 34 of the tubing hanger 12. As shown in FIG. 1, the tubing hanger alignment arrangement 32 is integrally formed with the first housing portion 20, being formed in the axial throughbore 24.

The wellhead apparatus 10 provides a number of benefits over conventional tools and equipment. For example, the wellhead apparatus 10 incorporates the orientation of the tubing hanger 12 and thus the associated downhole tubing 14, tools and equipment into the wellhead 10, facilitating the correct orientation of the tubing hanger 12 in the wellhead 10 without the requirement for an Orientation Spool, BOP pin or Tubing Head Spool as is required with conventional wellbore construction equipment, reducing costs and installation duration. Moreover, by eliminating the need for the Orientation Spool or Tubing Head Spool, the wellhead apparatus 10 reduces installation time and thus involves lower fatigue loading on the wellhead system. Incorporating the orientation of the tubing hanger 12 into the wellhead 10 also permits the system to be fully verified prior to deployment, e.g. at an onshore location, thereby providing greater confidence of successful installation offshore and reducing the likelihood of a failure which would otherwise require a remedial or intervention operation to be carried out at significant cost and time. The wellhead apparatus 10 is particularly beneficial in subsea applications due to the complexities in performing operations in the subsea environment and the need to provide accurate orientation of the tubing hanger and associated downhole tubing and equipment.

As shown in FIG. 1, the wellhead apparatus 10 is configured for location on a conductor casing 36 (referred hereinbelow as "the conductor") extending upwards from the seabed S. The second housing portion 22 is configured for coupling for the conductor 36, via a weld connection 38. The conductor 36 takes the form of a suction can. Beneficially, the use of a suction can as the initial conductor provides accurate control over the orientation of the conductor 36, and thus accurate control over the orientation of the wellhead apparatus 10 and/or production guide base (not shown). In turn, the tubing hanger alignment arrangement 32 facilitates accurate alignment between the tubing hanger 12 and the wellhead apparatus 10, and thus between the tubing hanger 12 and associated downhole tubing 14 and equipment with the conductor 36.

As shown in FIG. 1, the wellhead assembly 100 also comprises a casing hanger arrangement, generally denoted 40, and the tubing hanger 12.

As shown in FIG. 2, the casing hanger arrangement 40 comprises a casing hanger 42 and a dummy hanger 44. The wellhead apparatus 10 is configured to receive the casing hanger 42, the wellhead apparatus 10 configured to receive the casing hanger 42 within the axial throughbore 24 of first housing portion 20.

The wellhead apparatus 10 comprises a casing hanger support arrangement 46 configured to support the casing hanger arrangement 40 and associated downhole tubing, tools and/or equipment. The casing hanger support arrangement 46 of the wellhead apparatus 10 takes the form of a landing shoulder for receiving the casing hanger arrangement 40, the casing hanger support arrangement 46 formed in the axial throughbore 18 of the wellhead apparatus 10, and more particularly in the axial throughbore 24 of first housing portion 20.

In use, the dummy hanger 44 is configured to land on the support arrangement 46, the dummy hanger 44 defining a profile 48 configured to land on the support arrangement 46.

The casing hanger 42 is configured to receive the tubing hanger 12. The tubing hanger 12 comprises a seal arrangement 50. In the illustrated wellhead assembly 100, the seal arrangement 50 interfaces with and seals within the casing hanger 42.

In use, the casing hanger arrangement 40 is run into the axial throughbore 18 of the wellhead apparatus 10 and landed on the casing hanger support arrangement 46. The tubing hanger 12 is then run into the axial throughbore 18 of the wellhead apparatus 10 and landed on the casing hanger 38.

A seal arrangement 52 is disposed between the casing hanger 42 and the wellhead apparatus 10, in particular the first housing portion 20, the seal arrangement 52 taking the form of a metal-to-metal seal arrangement.

As shown, the wellhead apparatus 10 comprises a lock arrangement 54 for locking the tubing hanger 12 in place on location of the tubing hanger 12 in the wellhead apparatus 10. The lock arrangement 54 is configured to engage a locking arrangement 56 provided on tubular body 58 of the tubing hanger 12. In the illustrated apparatus 10, the lock arrangement 54 takes the form of a lock recess or profile provided in the axial throughbore 24 of the first housing portion 20 of the wellhead apparatus 10 and the lock arrangement 56 comprises a plurality of lock dogs which are actuatable to a radially outwards position to engage the lock recess or profile in the throughbore 24. As shown, the lock arrangement 54 is disposed at an uphole location relative to the casing hanger support arrangement 40.

The wellhead assembly and apparatus may be provided in a number of different configurations.

In the illustrated assembly 100 and apparatus 10, the wellhead apparatus 10 comprises an 18¾" (476.25 mm) first housing portion 20 having an 18.12" (460.25 mm) bore for receiving the casing hanger 42, which in the illustrated assembly 100 is a 18.12" (460.25 mm) outer diameter casing hanger. Beneficially, this provides space for the tubing hanger alignment arrangement 32 and facilitates the use of proven and readily available casing hanger technology.

Figure 4:
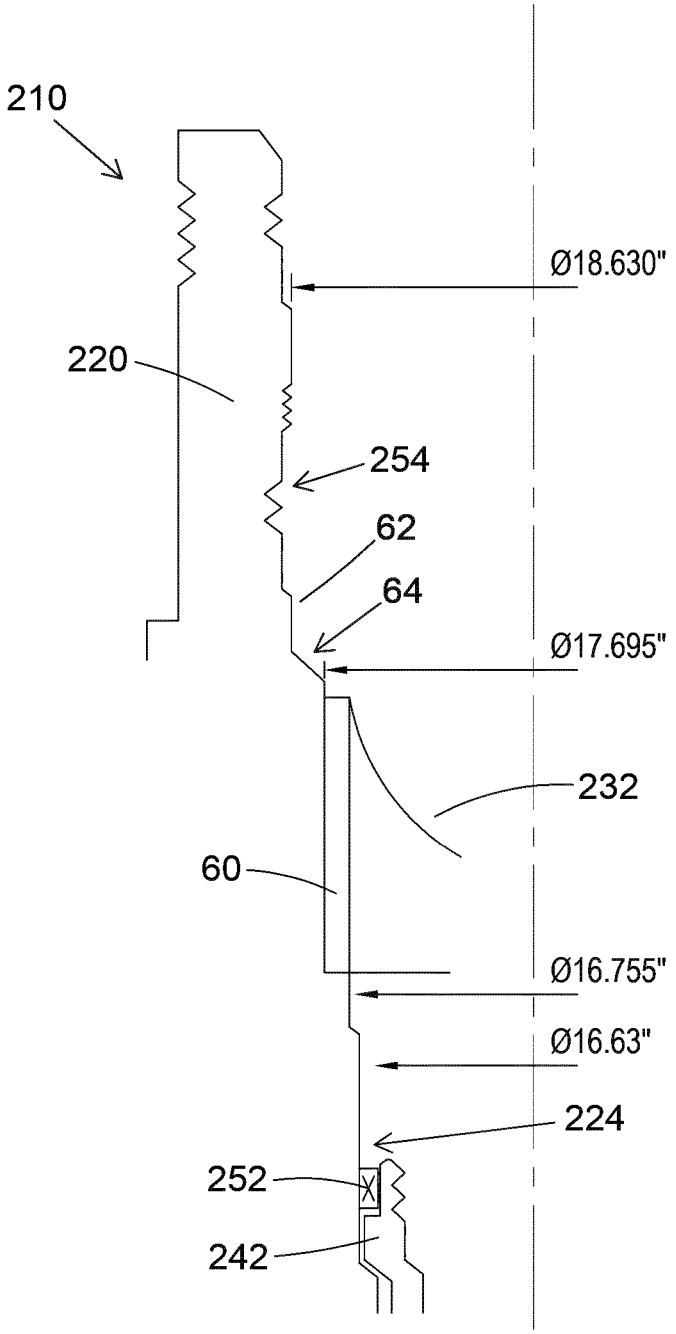
FIG. 4 shows a diagrammatic view of part of an alternative wellhead apparatus.

Referring now to FIG. 4 of the accompanying drawings, there is shown an alternative configuration of apparatus 210. Like components with the apparatus 10 are represented by like numerals incremented by 200.

As in the apparatus 10, the apparatus 210 comprises a first housing portion 220 having a tubing hanger alignment arrangement 232 which in the illustrated apparatus 210 takes the form of a helical profile. As shown in FIG. 4, in the illustrated wellhead apparatus 210 the tubing hanger alignment arrangement 232 is provided on a sleeve 60.

The apparatus 210 comprises a lock arrangement 254 for locking the tubing hanger in place on location of the tubing hanger in the wellhead apparatus 210. The lock arrangement 254 takes the form of a lock recess or profile provided in the axial throughbore 224 of the first housing portion 220. Whereas in the apparatus 10 the tubing hanger seal arrangement 50 is configured to engage and seal within the casing hanger 42, in the apparatus 210 the tubing hanger is configured to engage and seal within the first body portion 220 at surface 62.

The apparatus 210 further comprises tubing hanger support arrangement 64 in the form of landing profile.

The wellhead apparatus 210 is configured to receive a casing hanger 242 in the form of 16¾" (425.45 mm) outer diameter casing hanger 242. As in the apparatus 10, a seal arrangement 252 is disposed between the casing hanger 242 and the wellhead apparatus 210, in particular the first housing portion 220, the seal arrangement 252 taking the form of a metal-to-metal seal arrangement.

The wellhead apparatus and assembly provide a number of benefits over conventional tools and equipment. For example, the wellhead assembly incorporates the orientation of the tubing hanger and thus the associated downhole tubing, tools and equipment into the wellhead apparatus, facilitating the correct orientation of the tubing hanger in the wellhead apparatus without the requirement for an Orientation Spool, BOP pin or Tubing Head Spool as is required with conventional wellbore construction equipment, reducing costs and installation duration. Moreover, by eliminating the need for the Orientation Spool or Tubing Head Spool, the wellhead apparatus reduces installation time and thus involves lower fatigue loading on the wellhead system. Incorporating the orientation of the tubing hanger into the wellhead apparatus also permits the system to be fully verified prior to deployment, e.g. at an onshore location, thereby providing greater confidence of successful installation offshore and reducing the likelihood of a failure which would otherwise require a remedial or intervention operation to be carried out at significant cost and time.

Referring now to FIGS. 5 to 14 of the accompanying drawings, there is shown an alternative wellhead assembly 300 (shown in FIGS. 11 and 13) comprising a wellhead apparatus 310 (shown in FIG. 5) and a tubing hanger 312 (shown in FIG. 10) suitable for supporting downhole tubing 314 (shown in FIG. 10) and associated downhole tools and equipment within the wellhead apparatus 310. As will be described in more detail below, the wellhead apparatus 310 comprises a housing portion 320 in the form of high pressure (HP) housing unit, a conductor housing 326 (both shown in FIG. 5), and an orientation sleeve 360 (shown in FIG. 9) for location in and configured to be supported by the first housing portion 320, the orientation sleeve 360 configured to receive and support the tubing hanger 312.

As in the apparatus 210 described above, the apparatus 310 comprises a tubing hanger alignment arrangement 332 including a helical profile provided on the sleeve 360.

Figure 5:
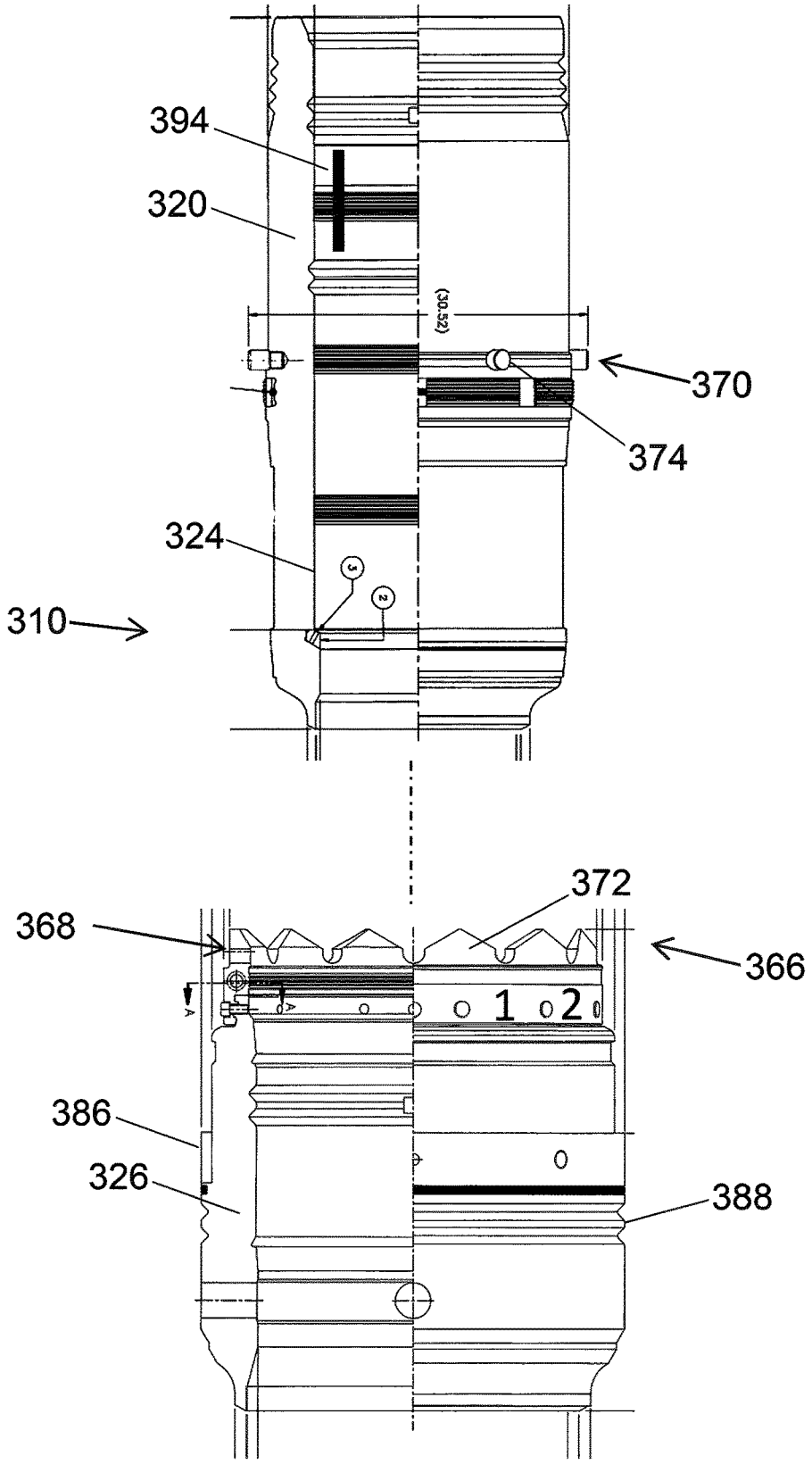
FIG. 5 shows a part cut away view of an alternative wellhead apparatus.

As shown in FIG. 5, the wellhead apparatus 310 further comprises an alignment arrangement, generally denoted 366, for orienting the first housing portion (HP housing unit) 320 relative to the conductor housing 326. In the illustrated apparatus 310, the alignment arrangement 366 comprises a castellated profile 368 provided on conductor housing 326, the castellated profile 368 configured to engage a pin arrangement 370 on the first housing portion 320.

In the illustrated apparatus 310, the castellated profile 368 comprises a plurality of circumferentially arranged and spaced castellations 372 and the pin arrangement 370 comprises a plurality of circumferentially arranged and spaced pins 374.

In use, the pins 374 interface with the castellations 372 on the top of the conductor housing 326 to lock the orientation of the first housing portion 320 to the conductor housing 326.

Figure 6:
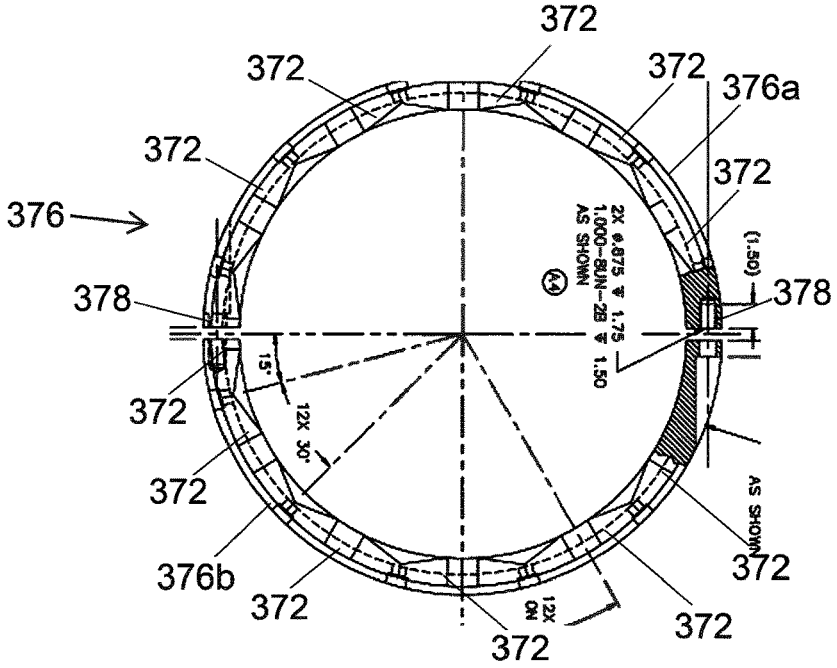
FIGS. 6, 7 and 8 show a plan view of a ring member forming part of an alignment arrangement of the wellhead apparatus shown in FIG. 5.
Figure 7:
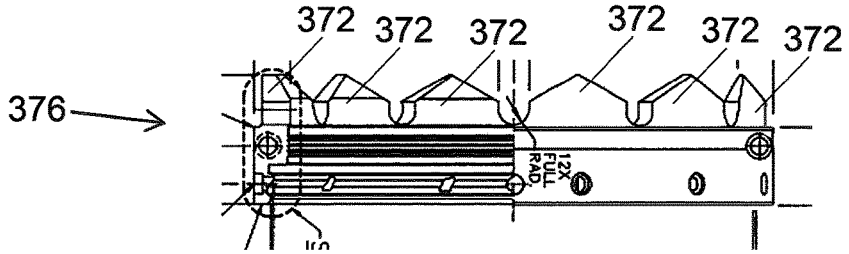

As shown in FIG. 6, in the illustrated apparatus 310 the castellated profile 368 comprises twelve castellations 372 at 30 degree circumferential spacing. Beneficially, this reduces the rotation required in order to engage the alignment arrangement 366 and thus align and lock the orientation of the first housing portion 320 and the conductor housing 326.

In the illustrated apparatus 310, the castellated profile 368 is formed on a separate ring member 376 coupled to the conductor housing 326. The ring member 376 is formed as two parts **376*a*,376*b*, having bores 378 for receiving fasteners for coupling the parts 376*a*,376*b*** together.

Figure 8:
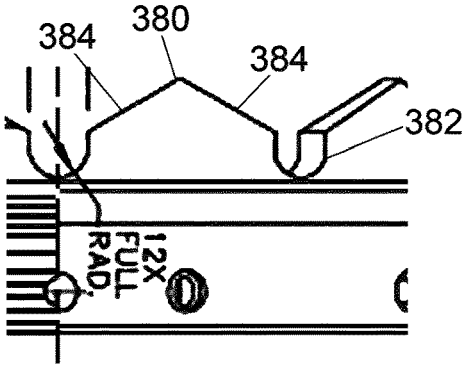

As shown most clearly in FIG. 8, the castellated profile 368 has peaks 380 (defined by the top of the castellations 372) and troughs 382 between the castellations 372. Each castellation 372 generally takes the form of a tooth having tapered surfaces 384. Beneficially, this assists with guiding the pins 374 into the troughs 382. In the illustrated apparatus 310, the troughs 382 are generally u-shaped.

Referring again in particular to FIG. 5, the apparatus 310 further comprises an orientation profile 386 and latching profile 388 for alignment with and/or attaching a production flow base and/or for tree alignment. The profiles 386,388 are formed on the outer diameter of the conductor housing 326.

As shown in FIG. 5, the apparatus 310 further comprises an orientation slot 394 configured to receive the tubing hanger orientation sleeve 360. The orientation slot 394 is formed in the first housing portion 320. The position of the orientation slot 394 is in a known position relative to one of the pins 374, referred to as the "king pin".

Beneficially, engagement of the sleeve 360 with the orientation slot 394 in the first housing portion 320 aligns the sleeve 360 with the first housing portion 320, which in turn is aligned relative to the conductor housing 326 via the alignment arrangement 366.

Figure 9:
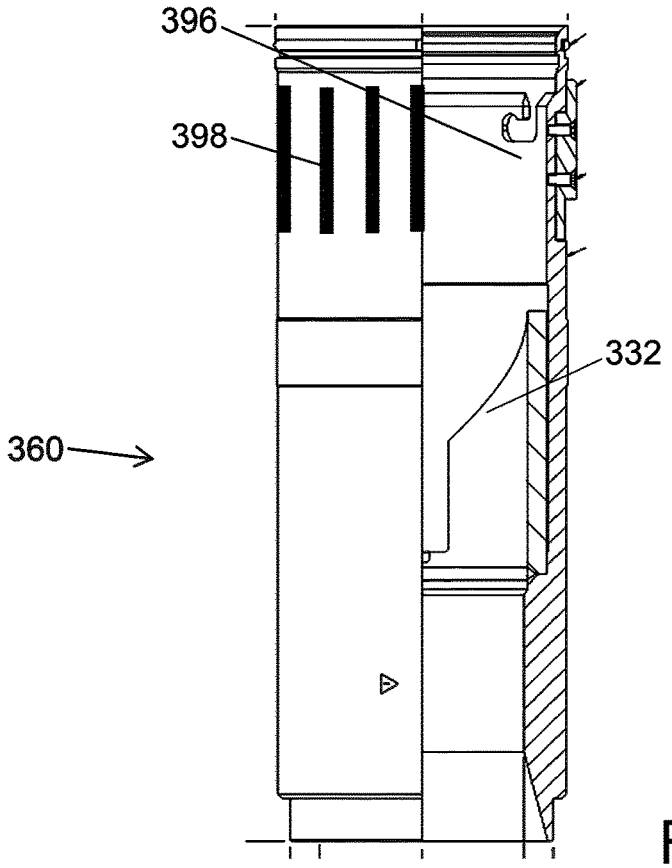
FIG. 9 shows a part cut away view of an orientation sleeve of the wellhead apparatus shown in FIG. 5.

Referring now to FIG. 9 of the accompanying drawings, there is shown a longitudinal cut-away view of the sleeve 360 of the apparatus 310. As shown in FIG. 9, the sleeve 360 comprises a spring loaded orientation key 396, and orientation key position slots 398. As described above, the sleeve 360 further comprises the orientation helix and slot 332 for the alignment of the tubing hanger 312 relative to the well heading as determined by the ROV (not shown) and the Latching/Orientation Profile 386,388 on the outer diameter of the conductor housing 326 for the tree alignment/production flow base.

Figure 10:
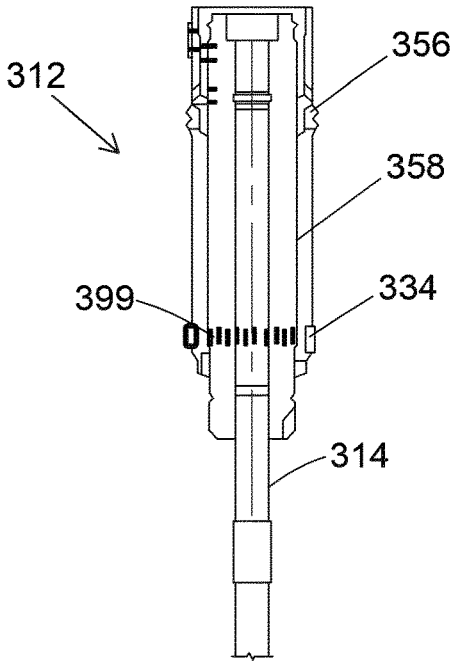
FIG. 10 shows a tubing hanger for use with the wellhead apparatus shown in FIG. 5.

FIG. 10 of the accompanying drawings shows the tubing hanger 312. As shown in FIG. 10, the tubing hanger 312 has a locking arrangement 356 provided on a tubular body 358 of the tubing hanger 312, in the illustrated apparatus 310 the lock arrangement 356 comprising a plurality of lock dogs which are actuatable to a radially outwards position to engage the lock recess or profile in throughbore 324 of the first housing portion 320.

A wellhead alignment arrangement 334 is provided in the body 358, the alignment arrangement 334 in the illustrated tubing hanger 312 taking the form of a key. As shown in FIG. 10, the tubing hanger 312 comprises a number of additional orientation key position slots 399.

It will be recognized that correction of the tubing hanger orientation can be achieved either by way of a moveable key on the orientation sleeve 360 and a fixed key on the tubing hanger 312 or by a moveable key on the tubing hanger 312 and a fixed key on the body 358 of the tubing hanger 312.

In use, the conductor housing 326 is first installed and cemented or jetted in place. After the conductor housing is installed the head of the alignment features of the conductor housing 326 are determined with a ROV (not shown). The well heading is taken from the conductor housing.

The well is then drilled to total depth ("TD") as required by the drilling program, then after the production casing string and casing hanger has been landed and sealed in the first housing portion 320, the tubing hanger orientation sleeve 360 is prepared and run and locked into the first housing portion 320.

Preparation of the orientation sleeve 360 requires determining the angular offset between the well heading as determined by the ROV, the king pin and the known angular orientation between the king pin and the orientation slot 394 in the inner diameter of the first housing portion 320 and setting the required angular orientation between the external orientation key 396 and the inner tubing hanger alignment slot 332 on the orientation sleeve 360, such that when it is landed and locked in the first housing portion 320 the installation of the tubing hanger 312 will be aligned with the required well heading and the tree alignment/production flow base 400 once this item is installed, as shown and described with reference to FIG. 11 to 14.

Figure 11:
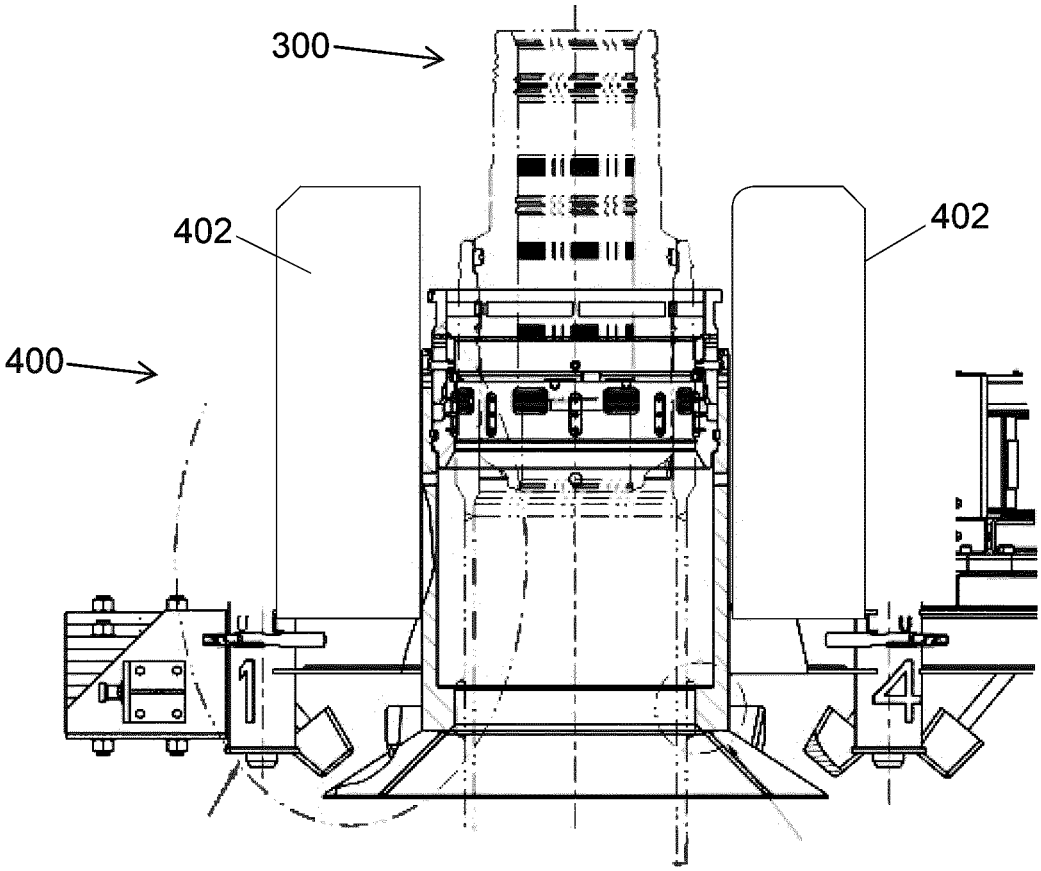
FIG. 11 shows a production flow base installed on a wellhead assembly incorporating the wellhead apparatus shown in FIG. 5.
Figure 12:
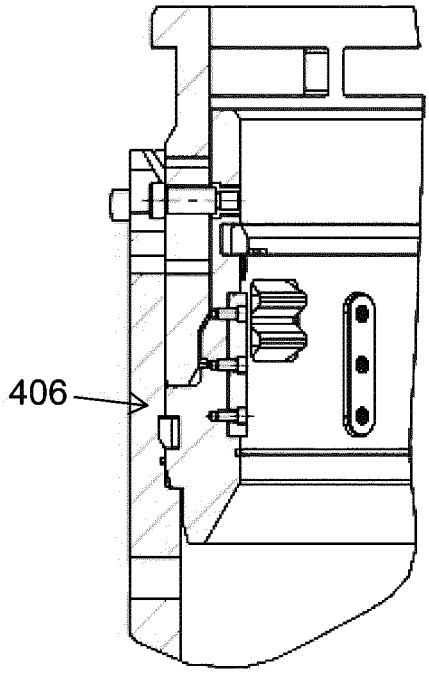
FIG. 12 shows an enlarged view of part of the production flow base and wellhead assembly shown in FIG. 11.

FIG. 11 shows a production flow base 400 installed on the wellhead assembly 300. As shown in FIG. 11, the production flow base 400 has alignment fins 402 to facilitate location and orientation of a Christmas tree XT (shown in FIG. 14) on the production flow base 400. As shown in FIG. 12, a latch 404 is provided to secure the production flow base 400 to the wellhead assembly 300.

Figure 13:
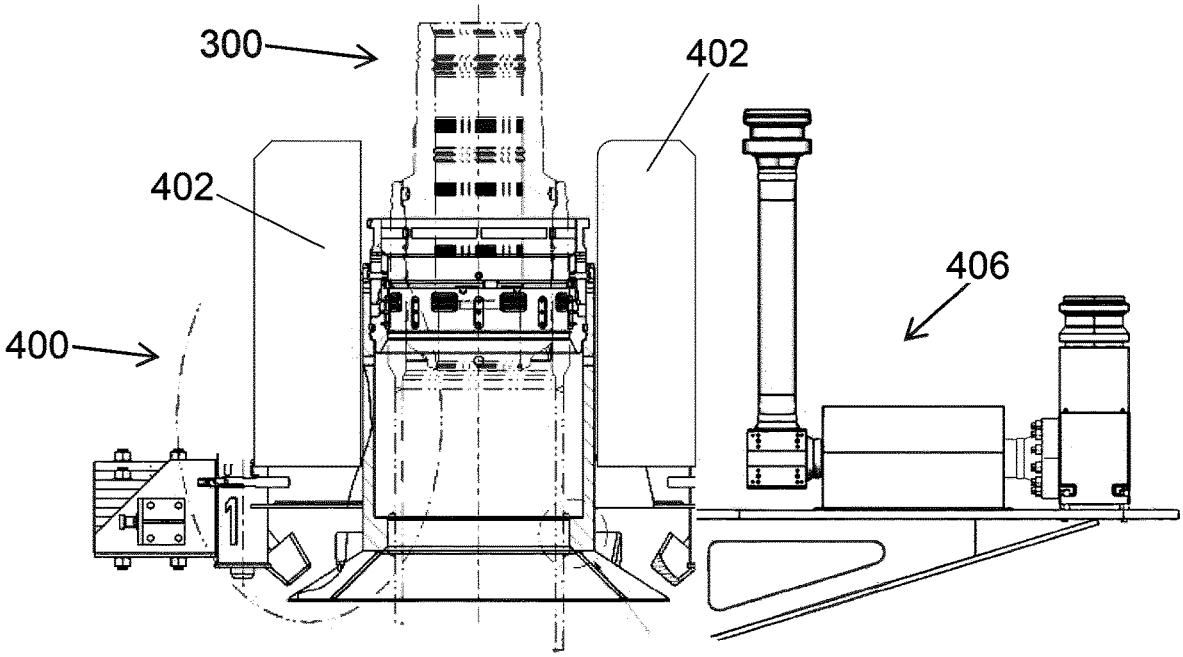
FIG. 13 shows the production flow base shown in FIG. 11, with a vertical well jumper spool installed.

FIG. 13 shows the production flow base 400 shown in FIG. 11, with a vertical well jumper spool 406 installed.

Figure 14:
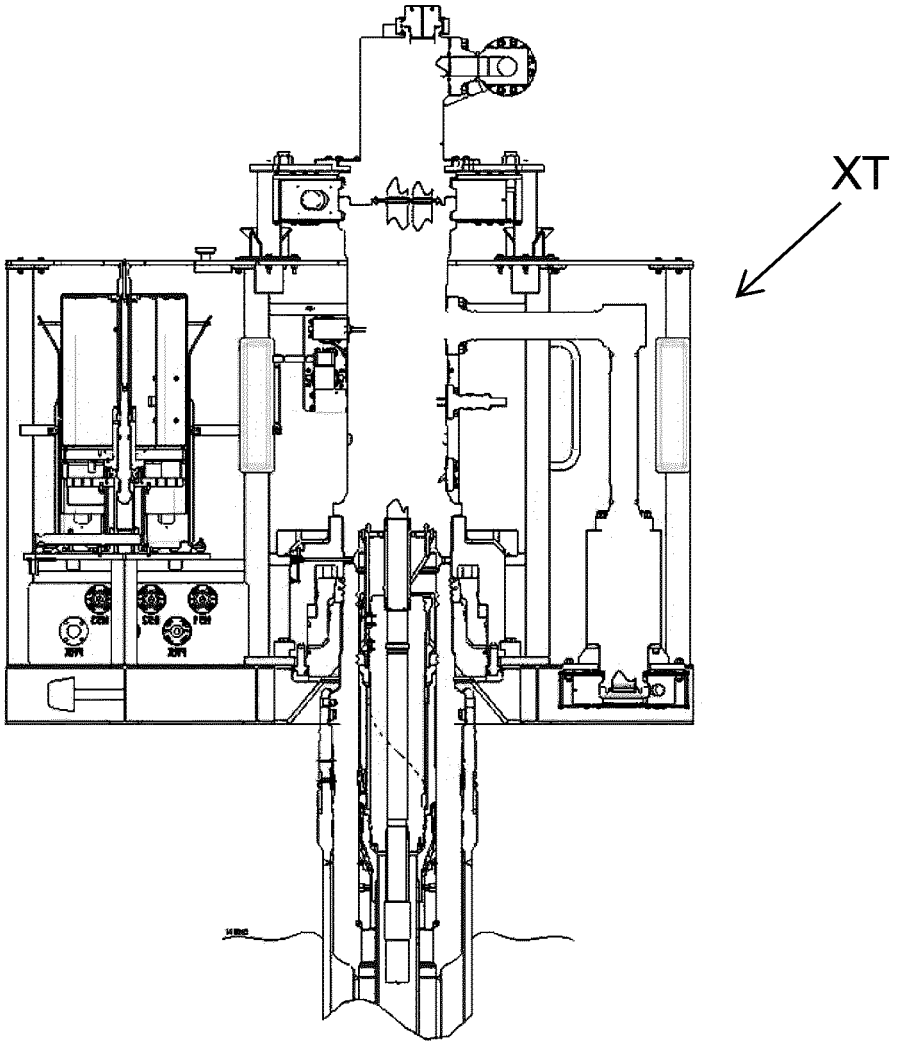
FIG. 14 shows a Christmas tree installed on the production flow base shown in FIG. 11.

FIG. 14 shows the Christmas tree XT installed on the production flow base 400 shown in FIGS. 11 and 13.

The wellhead apparatus 310 provides a number of benefits over conventional tools and equipment. For example, the wellhead apparatus 310 incorporates the orientation of the tubing hanger 312 and thus the associated downhole tubing, tools and equipment into the wellhead, facilitating the correct orientation of the tubing hanger 312 in the wellhead without the requirement for an Orientation Spool, BOP pin or Tubing Head Spool as is required with conventional wellbore construction equipment, reducing costs and installation duration. Moreover, by eliminating the need for the Orientation Spool or Tubing Head Spool, the wellhead apparatus 310 reduces installation time and thus involves lower fatigue loading on the wellhead system. Incorporating the orientation of the tubing hanger 312 into the wellhead also permits the system to be fully verified prior to deployment, e.g. at an onshore location, thereby providing greater confidence of successful installation offshore and reducing the likelihood of a failure which would otherwise require a remedial or intervention operation to be carried out at significant cost and time.

Moreover, the wellhead apparatus 310 provides the further benefit that it does not require initial orientation of the conductor housing 326 to be carried out. Amongst other things, this eliminates the costs and time associated with the build and supply of the tubing head spool, and/or results in significant reductions in rig time and associated operational and transportation costs.

It will be understood that various modifications may be made without departing from the scope of the claimed invention. For example, the apparatus can be used with both full bore and load shoulder wellhead/casing hanger solutions.

This written description uses examples to disclose the invention, including the preferred embodiments, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims. Aspects from the various embodiments described, as well as other known equivalents for each such aspects, can be mixed and matched by one of ordinary skill in the art to construct additional embodiments and techniques in accordance with principles of this application.

The invention claimed is:

1. A wellhead apparatus for supporting downhole tubing, comprising:

a tubular body defining an axial throughbore therethrough, wherein the wellhead apparatus is configured to receive a tubing hanger for supporting downhole tubing from the wellhead;

a tubing hanger alignment arrangement provided in the axial throughbore of the wellhead apparatus, wherein the tubing hanger alignment arrangement is configured to engage a wellhead alignment arrangement of the tubing hanger so as to orient the tubing hanger relative to the wellhead on location of the tubing hanger in the wellhead apparatus, and wherein engagement of the tubing hanger alignment arrangement and the wellhead alignment arrangement causes the tubing hanger to rotate axially around the axial throughbore; and an alignment arrangement, wherein the alignment arrangement orients a first housing portion relative to a conductor housing.

2. The apparatus of claim 1, wherein the wellhead apparatus takes the form of a subsea wellhead.

3. The apparatus of claim 1, wherein the apparatus is configured for location on a conductor casing in the form of a suction can.

4. The apparatus of claim 1, wherein the tubing hanger alignment arrangement is integrally formed with the wellhead apparatus.

5. The apparatus of claim 4, wherein the tubing hanger alignment arrangement is integrally formed with the tubular body of the wellhead apparatus.

6. The apparatus of claim 1, wherein the tubing hanger alignment arrangement is disposed on a separate component configured for location in the axial throughbore of the tubular body.

7. The apparatus of claim 1, wherein the tubing hanger alignment arrangement comprises or takes the form of a profile.

8. The apparatus of claim 7, wherein the profile comprises or takes the form of a helical profile.

9. The apparatus of claim 1, configured to receive a casing hanger, the wellhead apparatus comprising a casing hanger support arrangement configured to support the casing hanger and associated downhole tubing, tools and/or equipment.

10. The apparatus of claim 9, wherein the casing hanger support arrangement of the wellhead apparatus comprises or takes the form of a landing shoulder, nipple and/or no-go.

11. The apparatus of claim 1, comprising a tubing hanger lock arrangement for locking the tubing hanger in place on location of the tubing hanger in the wellhead apparatus.

12. The apparatus of claim 11, wherein at least one of:

the tubing hanger lock arrangement is configured to engage a wellhead locking arrangement of the tubing hanger;

the tubing hanger lock arrangement comprises or takes the form of a lock recess or profile provided in the wellhead apparatus.

13. The apparatus of claim 1, wherein at least one of:

the alignment arrangement comprises a castellated profile formed or provided on the conductor housing;

the alignment arrangement comprises a pin arrangement formed or provided on the first housing portion.

14. A wellhead assembly comprising:

the wellhead apparatus of claim 1; and a tubing hanger.

15. The assembly of claim 14, wherein the tubing hanger comprises a wellhead alignment arrangement configured to engage the tubing hanger alignment arrangement of the wellhead apparatus.

16. The assembly of claim 15, wherein the wellhead alignment arrangement of the tubing hanger comprises or takes the form of a key.

17. The assembly of claim 14, wherein the tubing hanger comprises a wellhead locking arrangement.

18. The assembly of claim 14, comprising a casing hanger arrangement.

19. The assembly of claim 15, comprising a casing hanger arrangement, wherein the casing hanger arrangement comprises a casing hanger, the casing hanger comprising a receiver configured to receive the wellhead alignment arrangement of the tubing hanger.

20. A wellhead apparatus for supporting downhole tubing, comprising:

a first housing portion;

a conductor housing;

a tubing hanger orientation sleeve; and an alignment arrangement, wherein the alignment arrangement orients the first housing portion relative to the conductor housing.

21. The apparatus of claim 20, wherein at least one of:

the alignment arrangement comprises a castellated profile formed or provided on the conductor housing;

the alignment arrangement comprises a pin arrangement formed or provided on the first housing portion.

22. A wellhead assembly comprising:

the wellhead apparatus of claim 20; and a tubing hanger.

23. The wellhead assembly of claim 22, further comprising:

a production flow base.

24. The wellhead assembly of claim 23, wherein the production flow base has an alignment fin.

25. The wellhead assembly of claim 24, wherein the alignment fin facilitates location and orientation of a Christmas tree.

* * * * *